US009856674B1

(12) United States Patent
Pond

(10) Patent No.: US 9,856,674 B1
(45) Date of Patent: Jan. 2, 2018

(54) TEMPORARY FENCE ASSEMBLY

(71) Applicant: Tawny Pond, Seattle, WA (US)

(72) Inventor: Tawny Pond, Seattle, WA (US)

( * ) Notice: Subject to any disclaimer, the term of this patent is extended or adjusted under 35 U.S.C. 154(b) by 0 days.

(21) Appl. No.: 15/610,971

(22) Filed: Jun. 1, 2017

(51) Int. Cl.

| | |
|---|---|
| ***E04H 17/16*** | (2006.01) |
| ***E04H 17/14*** | (2006.01) |
| ***E04H 12/22*** | (2006.01) |
| ***E04H 17/22*** | (2006.01) |
| ***E01F 13/02*** | (2006.01) |

(52) U.S. Cl.
CPC ..... *E04H 17/168* (2013.01); *E01F 13/022* (2013.01); *E04H 12/2246* (2013.01); *E04H 17/1413* (2013.01); *E04H 17/22* (2013.01)

(58) Field of Classification Search
CPC ..... E03B 3/00; E03B 3/02; E03B 3/03; E04H 17/1404; E02B 3/108; E01F 15/086; E01F 15/088
See application file for complete search history.

(56) References Cited

U.S. PATENT DOCUMENTS

| | | | | |
|---|---|---|---|---|
| 4,193,584 A * | 3/1980 | Wieser | A01K 1/0005 | 119/513 |
| 5,460,353 A | 10/1995 | Rittenhouse | | |
| 5,813,662 A | 9/1998 | Langkrus | | |
| 5,882,140 A * | 3/1999 | Yodock, Jr. | E01F 15/083 | 256/13.1 |
| 5,979,844 A | 11/1999 | Hopkins | | |
| 6,059,491 A * | 5/2000 | Striefel | E01F 15/086 | 256/13.1 |
| 6,086,285 A * | 7/2000 | Christensen | E01F 13/022 | 256/1 |
| 7,416,364 B2 * | 8/2008 | Yodock, III | E01F 15/083 | 256/13.1 |
| 7,445,403 B2 * | 11/2008 | Williams | E02B 3/16 | 404/6 |
| 7,494,111 B2 | 2/2009 | Short | | |
| 8,474,195 B1 * | 7/2013 | Anchondo | E03B 3/03 | 405/284 |
| 8,662,790 B2 * | 3/2014 | Phelps | E02B 3/108 | 403/298 |
| 9,279,271 B2 | 3/2016 | McDowell | | |

(Continued)

FOREIGN PATENT DOCUMENTS

| | | | | |
|---|---|---|---|---|
| DE | EP 2468958 A1 * | 6/2012 | E01F 15/086 | |
| PA | EP 0305624 A1 * | 3/1989 | E01F 15/086 | |

OTHER PUBLICATIONS

Machine Translation of EP0305624, https://worldwide.espacenet.com, Generated Aug. 15, 2017, 4 Pages.*

*Primary Examiner* — Daniel Wiley

(57) ABSTRACT

A temporary fence assembly includes a plurality of post units. Each of the post units is vertically oriented on a support surface and the plurality of post units is arranged to surround a selected area. Each of the post units is substantially hollow and each of the post units is selectively filled with a liquid thereby increasing a weight corresponding to each of the post units. A plurality of wall units is provided and each of the wall units is slidably coupled between a selected pair of the post units to barricade the selected area. Each of the wall units is substantially hollow and each of the wall units is selectively filled with a liquid thereby increasing a weight corresponding to each of the wall units.

12 Claims, 5 Drawing Sheets

(56) References Cited

U.S. PATENT DOCUMENTS

| | | | | |
|---|---|---|---|---|
| 2003/0219308 | A1* | 11/2003 | Boulais ..... | E01F 13/024 404/6 |
| 2014/0034152 | A1 | 2/2014 | Drummond | |

* cited by examiner

TEMPORARY FENCE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to fence devices and more particularly pertains to a new fence device that for temporarily surrounding a selected area.

BRIEF SUMMARY OF THE INVENTION

An embodiment of the disclosure meets the needs presented above by generally comprising a plurality of post units. Each of the post units is vertically oriented on a support surface and the plurality of post units is arranged to surround a selected area. Each of the post units is substantially hollow and each of the post units is selectively filled with a liquid thereby increasing a weight corresponding to each of the post units. A plurality of wall units is provided and each of the wall units is slidably coupled between a selected pair of the post units to barricade the selected area. Each of the wall units is substantially hollow and each of the wall units is selectively filled with a liquid thereby increasing a weight corresponding to each of the wall units.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
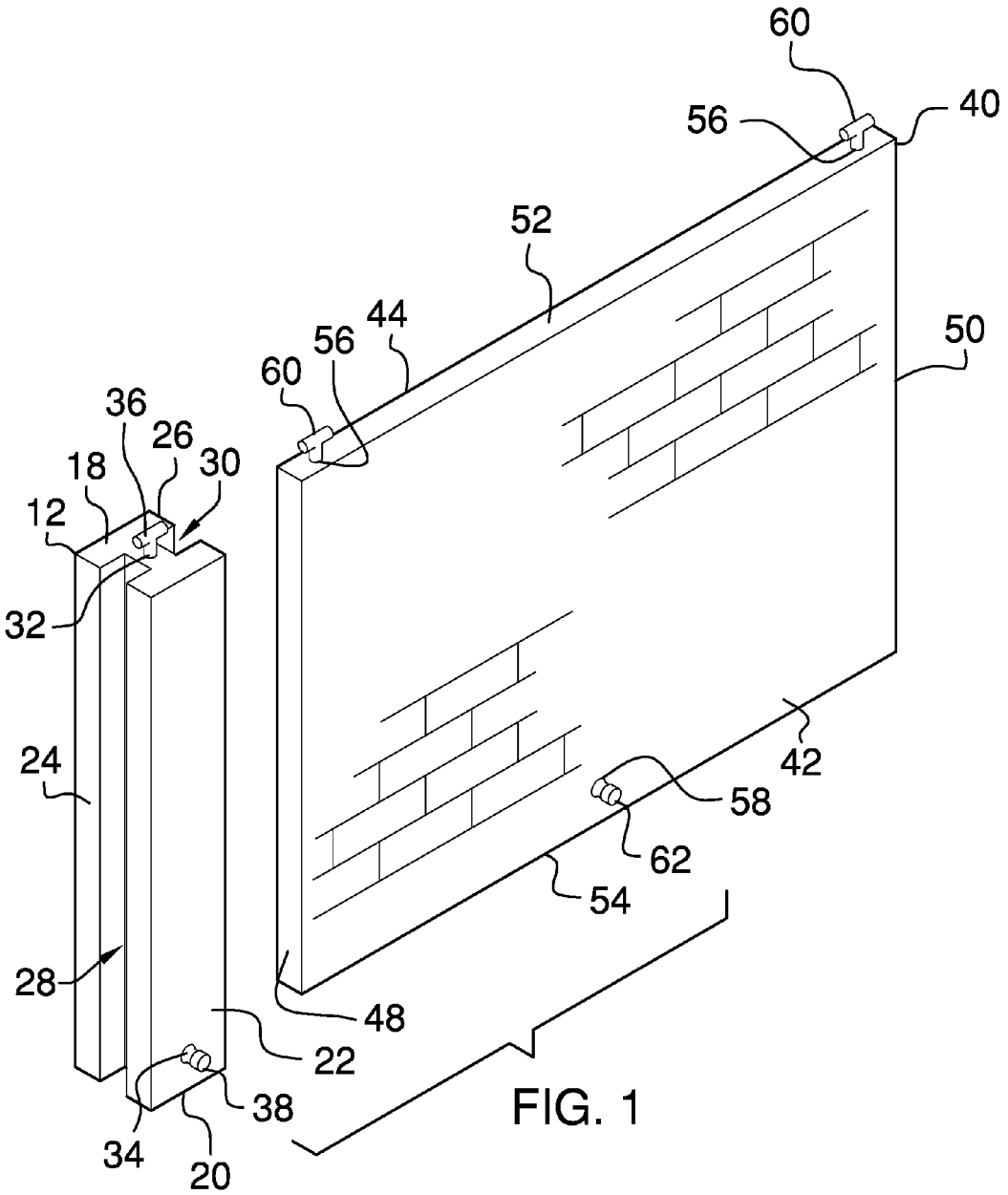
FIG. 1 is a front perspective view of a temporary fence assembly according to an embodiment of the disclosure.
Figure 2:
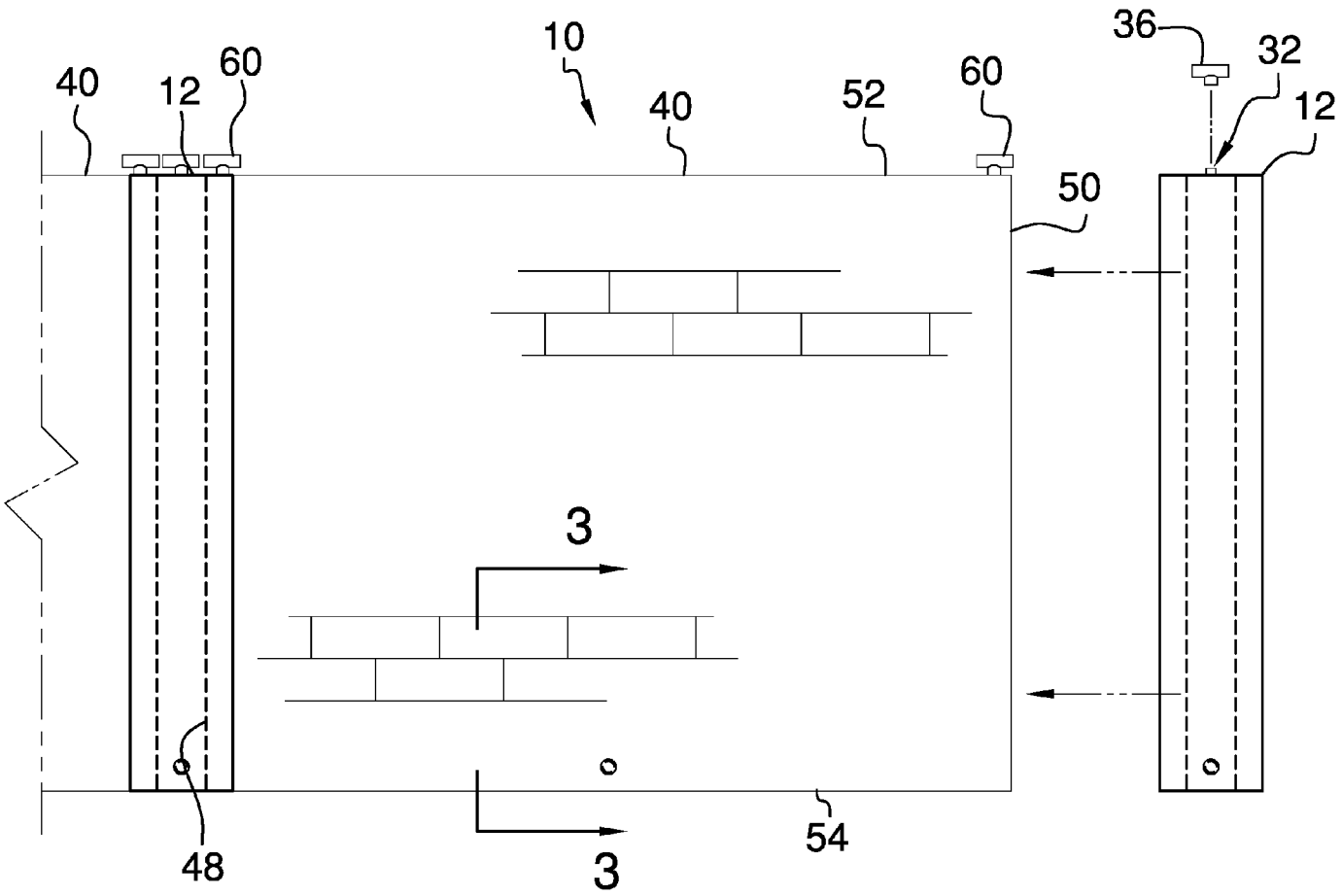
FIG. 2 is a front view of an embodiment of the disclosure.
Figure 3:
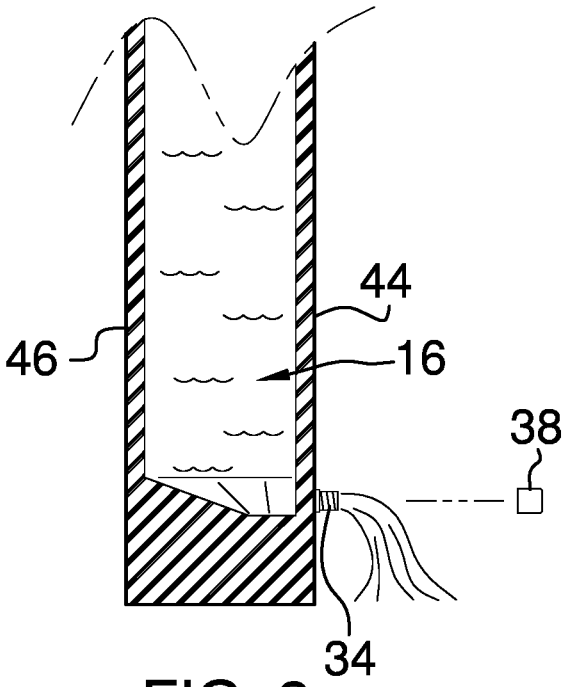
FIG. 3 is a cross sectional view taken along line 3-3 of FIG. 2 of an embodiment of the disclosure.
Figure 4:
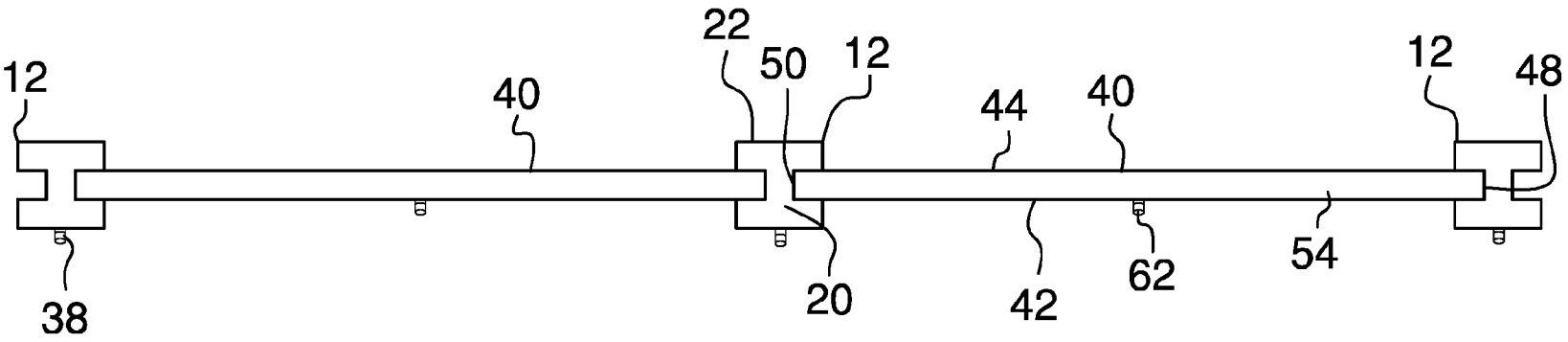
FIG. 4 is a bottom view of an embodiment of the disclosure.
Figure 5:
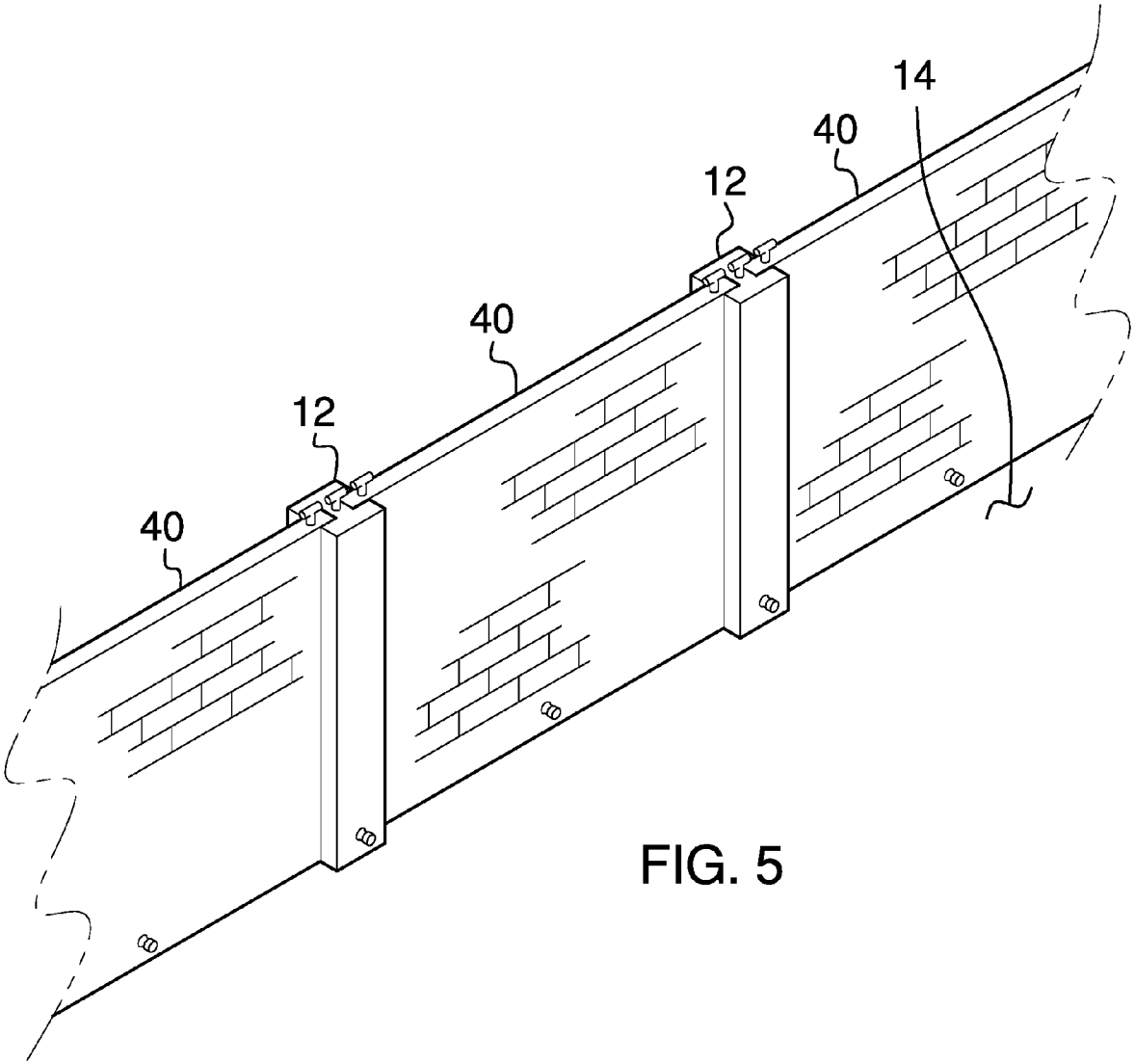
FIG. 5 is a perspective in-use view of an embodiment of the disclosure.

With reference now to the drawings, and in particular to FIGS. 1 through 5 thereof, a new fence device embodying the principles and concepts of an embodiment of the disclosure and generally designated by the reference numeral 10 will be described.

As best illustrated in FIGS. 1 through 5, the temporary fence assembly 10 generally comprises a plurality of post units 12. Each of the post units 12 is vertically oriented on a support surface 14 having the plurality of post units 12 being arranged to surround a selected area. The support surface 14 may be ground and the selected area may be a yard or the like. Each of the post units 12 is substantially hollow and each of the post units 12 is selectively filled with a liquid 16, such as water or the like, thereby increasing a weight corresponding to each of the post units 12. In this way each of the post units 12 is retained on the support surface 14 without having the post units 12 penetrating the support surface 14.

Each of the post units 12 has a top wall 18, a bottom wall 20 and an outer wall 22 extending therebetween. The outer wall 22 has a first lateral side 24 and a second lateral side 26 and each of the post units 12 is elongated between the top 18 and bottom 20 walls. The first lateral side 24 has a first groove 28 extending toward the second lateral side and the first groove 28 extends between the top wall 18 and the bottom wall 20. The second lateral side 26 has a second groove 30 extending toward the first lateral side 24 and the second groove 30 extends between the top wall 18 and the bottom wall 20. The bottom wall 20 abuts the support surface 14 when the posts units are positioned on the support surface 14. Each of the post units 12 may have a height ranging between approximately 1.5 meters and 2.0 meters.

The top wall 18 has a first aperture 32 extending into an interior of the post unit and the liquid 16 is poured through the first aperture 32. The outer wall 22 has a second aperture 34 extending into an interior of the post unit to drain the liquid 16 outwardly therefrom. The second aperture 34 is positioned closer to the bottom wall 20 than the top wall 18. A first cap 36 is removably positioned in the first aperture 32 to close the first aperture 32. A second cap 38 is removably positioned in the second aperture 34 to close the second aperture 34.

A plurality of wall units 40 is provided and each of the wall units 40 is slidably coupled between a selected pair of the post units 12. In this way the plurality of wall units 40 is positioned to barricade the selected area in the convention of a fence. Each of the wall units 40 is substantially hollow and each of the wall units 40 is selectively filled with the liquid 16 thereby increasing a weight corresponding to each of the wall units 40. In this way the plurality of wall units 40 are retained in an upright position and resists being tipped over by wind and the like. Each of the wall units 40 may have a height ranging between approximately 1.5 meters and 2.0 meters and a width ranging between approximately 1.5 meters and 3.0 meters.

Each of the wall units 40 comprises a front wall 42, a back wall 44 and a perimeter wall 46 extending therebetween. The perimeter wall 46 has a first lateral side 48, a second lateral side 50, a top side 52 and a bottom side 54. The first lateral side 48 of the wall unit 40 is positioned in the first groove 28 in a selected one of the post units 12. Additionally, the second lateral side 50 of the wall unit 40 is positioned in the second groove 30 in a selected one of the post units 12. In this way the wall unit 40 extends between the selected post units 12 having the bottom side 54 abutting the support surface 14 Each of the front 42 and back 44 walls may be textured to have the appearance of brick, stone, lumber or other material common to fence construction.

The top side 52 has a pair of first holes 56 extending into an interior of the wall unit 40 to have the liquid 16 poured therethrough. The front wall 42 has a second hole 58 extending into an interior of the wall unit 40 to drain the liquid 16 outwardly therefrom. A pair of primary caps 60 is each removably positioned an associated one of the first holes 56 to close the first holes 56 and a secondary cap 62 is removably positioned in the second hole 58 to close the second hole 58. Each of the first 56 and primary 60 caps may comprise a first member being oriented transverse to a second member. The second member may be gripped and the first member may be inserted into the corresponding first hole 56 and first aperture 32.

In use, each of the post units 12 is positioned on the support surface 14. Additionally, each of the post units 12 is selectively arranged to define a boundary around a selected area, a line extending along the area, and any other selected arrangement. Each of the wall units 40 is positioned to extend between an associated pair of the post units 12. In this way the plurality of post 12 and wall 40 units forms a fence. Each of the post units 12 and each of the wall units 40 are filled with the liquid 16 to inhibit the post 12 and wall 40 units from moving. Thus, each of the post units 12 and each of the wall units 40 are retained in the selected position without penetrating the support surface 14. The liquid 16 is selectively drained from each of the post 12 and wall 40 units to facilitate each of the post 12 and wall 40 units to be removed from the support surface 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A temporary fence assembly being configured to temporarily surround a selected area, said assembly comprising:

a plurality of post units, each of said post units being configured to be vertically oriented on a support surface having said plurality of post units being arranged to surround a selected area, each of said post units being substantially hollow wherein each of said post units is configured to be filled with a liquid thereby increasing a weight corresponding to each of said post units, and wherein each of said post units comprises:

a top wall, a bottom wall, and an outer wall extending vertically therebetween, said outer wall comprising opposing first and second lateral sides, at least one of said first and second lateral sides of each post unit comprising a groove thereon extending from the top wall to the bottom wall; and a plurality of wall units, each of said wall units being slidably coupled between a selected pair of said post units wherein said plurality of wall units is configured to barricade the selected area, each of said wall units being substantially hollow wherein each of said wall units is configured to be filled with a liquid thereby increasing a weight corresponding to each of said wall units, and wherein each of said wall units comprises:

a front wall, a back wall, and a perimeter wall extending therebetween, said perimeter wall comprising opposing first and second lateral sides, each of said first and second lateral sides of said wall unit being slidably coupled in, and of substantially the same length as, the at least one groove of a selected one of said post units.

2. The assembly according to claim 1, wherein said first lateral side has a first groove extending toward said second lateral side, said first groove extending between said top wall and said bottom wall.

3. The assembly according to claim 1, wherein said second lateral side has a second groove extending toward said first lateral side, said second groove extending between said top wall and said bottom wall.

4. The assembly according to claim 1, wherein said top wall has a first aperture extending into an interior of said post unit wherein said first aperture is configured to have the liquid poured therethrough.

5. The assembly according to claim 1, wherein said outer wall has a second aperture extending into an interior of said post unit wherein said second aperture is configured to drain the liquid outwardly therefrom, said second aperture being positioned closer to said bottom wall than said top wall.

6. The assembly according to claim 4, further comprising a first cap being removably positioned in said first aperture to close said first aperture.

7. The assembly according to claim 5, further comprising a second cap being removably positioned in said second aperture to close said second aperture.

8. The assembly according to claim 1, wherein:

each of said post units has a first groove and a second groove in the first and second lateral sides thereof, respectively; and each of said wall units comprises a top side and a bottom side, said first lateral side of said wall unit being positioned in said first groove in a selected one of said post units, said second lateral side of said wall unit being positioned in said second groove in a selected one of said post units such that said wall unit extends between said selected post units, said bottom side being configured to abut the support surface.

9. The assembly according to claim 8, wherein said top side has a first hole extending into an interior of said wall unit wherein said first hole is configured to have the liquid poured therethrough, said front wall having a second hole extending into an interior of said wall unit wherein said second hole is configured to drain the liquid outwardly therefrom.

10. The assembly according to claim 9, further comprising a primary cap being removably positioned in said first hole to close said first hole.

11. The assembly according to claim 9, further comprising a secondary cap being removably positioned in said second hole to close said second hole.

12. A temporary fence assembly being configured to temporarily surround a selected area, said assembly comprising:

a plurality of post units, each of said post units being configured to be vertically oriented on a support surface having said plurality of post units being arranged to surround a selected area, each of said post units being substantially hollow wherein each of said post units is configured to be filled with a liquid thereby increasing a weight corresponding to each of said post units, each of said post units comprising:

a top wall, a bottom wall and an outer wall extending therebetween, said outer wall having a first lateral side and a second lateral side, each of said post units being elongated between said top and bottom walls, said first lateral side having a first groove extending toward said second lateral side, said first groove extending between said top wall and said bottom wall, said second lateral side having a second groove extending toward said first lateral side, said second groove extending between said top wall and said bottom wall, said top wall having a first aperture extending into an interior of said post unit wherein said first aperture is configured to have the liquid poured therethrough, said outer wall having a second aperture extending into an interior of said post unit wherein said second aperture is configured to drain the liquid outwardly therefrom, said second aperture being positioned closer to said bottom wall than said top wall, said bottom wall being configured to abut the support surface, a first cap being removably positioned in said first aperture to close said first aperture, and a second cap being removably positioned in said second aperture to close said second aperture; and a plurality of wall units, each of said wall units being slidably coupled between a selected pair of said post units wherein said plurality of wall units is configured to barricade the selected area, each of said wall units being substantially hollow wherein each of said wall units is configured to be filled with a liquid thereby increasing a weight corresponding to each of said wall units, each of said wall units comprising:

a front wall, a back wall and a perimeter wall extending therebetween, said perimeter wall having a first lateral side, an opposing second lateral side, a top side and a bottom side, said first lateral side of said wall unit being positioned in, and substantially the same length as, said first groove in a selected one of said post units, said second lateral side of said wall unit being positioned in, and substantially the same length as, said second groove in a selected one of said post units such that said wall unit extends between said selected post units, said bottom side being configured to abut the support surface, said top side having a first hole extending into an interior of said wall unit wherein said first hole is configured to have the liquid poured therethrough, said front wall having a second hole extending into an interior of said wall unit wherein said second hole is configured to drain the liquid outwardly therefrom, a primary cap being removably positioned in said first hole to close said first hole, and a secondary cap being removably positioned in said second hole to close said second hole.

* * * * *